US011850613B2

(12) United States Patent
Knight

(10) Patent No.: US 11,850,613 B2
(45) Date of Patent: Dec. 26, 2023

(54) ALL-POLYMER PUMP DISPENSER WITH INTERNAL PLUG SEAL

(71) Applicant: RIEKE PACKAGING SYSTEMS LIMITED, Leicestershire (GB)

(72) Inventor: Simon Christopher Knight, South Wales (GB)

(73) Assignee: RIEKE PACKAGING SYSTEMS LIMITED

( * ) Notice: Subject to any disclaimer, the term of this patent is extended or adjusted under 35 U.S.C. 154(b) by 4 days.

(21) Appl. No.: 17/628,931

(22) PCT Filed: Jul. 23, 2020

(86) PCT No.: PCT/EP2020/070871
§ 371 (c)(1),
(2) Date: Jan. 21, 2022

(87) PCT Pub. No.: WO2021/013962
PCT Pub. Date: Jan. 28, 2021

(65) Prior Publication Data

US 2022/0250106 A1 Aug. 11, 2022

Related U.S. Application Data

(60) Provisional application No. 62/877,352, filed on Jul. 23, 2019.

(51) Int. Cl.
*B05B 11/00* (2023.01)
*B05B 11/10* (2023.01)

(52) U.S. Cl.
CPC ..... *B05B 11/1035* (2023.01); *B05B 11/1066* (2023.01)

(58) Field of Classification Search
CPC . B05B 11/1028–1035; B05B 11/0044–00442; A47K 5/1208–1209;
(Continued)

(56) References Cited

U.S. PATENT DOCUMENTS 3,752,366 A * 8/1973 Lawrence, Jr. ..... B05B 1/3431 222/335
3,910,458 A * 10/1975 Ewald ..... B05B 11/1032 222/207
(Continued)

FOREIGN PATENT DOCUMENTS

| | | |
|---|---|---|
| CA | 2166655 | 7/1996 |
| WO | 2016063015 | 4/2016 |
| WO | 2017072506 | 5/2017 |

OTHER PUBLICATIONS

Patent Cooperation Treaty (PCT), International Search Report and Written Opinion for Application PCT/EP2020/070871 filed Jul. 23, 2020, dated Nov. 10, 2020, International Searching Authority, EP.
(Continued)

*Primary Examiner* — Paul R Durand
*Assistant Examiner* — Randall A Gruby
(74) *Attorney, Agent, or Firm* — McDonald Hopkins LLC

(57) ABSTRACT

A pump dispenser comprises an actuator head (100) having a dispensing channel communicating with a nozzle outlet (122), a closure body (20) having a top facing (203), at least one engagement feature extending axially upward from the top facing, and a recess (210) formed in the top facing. The recess has a cylindrical sidewall (212) with a plurality of axially-aligned stoppers positioned along the cylindrical sidewall and an annular ledge (220) defining an inlet port at a bottom end of the recess, said ledge including a cylindrical abutment (240) extending axially upward within the recess (210). An internal plug (40) is positioned within the annular recess, and includes an annular disk (400) with at least one axially-aligned stopping flange (410) positioned at or around a periphery of said disk and a plurality of axially-aligned engagement flanges (420) positioned toward a center of said disk. A resilient bellows (30) has a cylindrical outlet (361) positioned in a deformable top wall (35) and a cylindrical
(Continued)

enclosure (32) extending downward from the deformable top wall. The cylindrical outlet connects to a plurality of axial outlet flanges (362) extending below the deformable top wall and supporting a central engagement nub (364). The inlet port is selectively held sealed by the annular disk (400), which is secured by at least one of (i) the engagement flanges (420) coupling to the engagement nub (364) and (ii) the at least one stopping flange (410) abutting the terminal end of at least one of the axial outlet flanges.

13 Claims, 7 Drawing Sheets

(58) Field of Classification Search
CPC ..... G01F 11/08; G01F 11/088; G01F 11/286; F04B 43/0063
See application file for complete search history.

(56) References Cited

U.S. PATENT DOCUMENTS 3,987,938 A * 10/1976 Cooprider ..... F04B 43/0063 222/211
4,394,939 A * 7/1983 Thor ..... B05B 11/1028 222/386
4,771,925 A * 9/1988 Stoffler ..... B05B 11/028 222/207
4,807,784 A * 2/1989 Jupin ..... A47K 5/1201 222/207
4,809,887 A * 3/1989 Jupin ..... B05B 11/1028 222/257
4,867,347 A * 9/1989 Wass ..... B05B 11/1015 222/207
4,913,322 A * 4/1990 Stoffler ..... B05B 11/0072 222/207
4,936,493 A * 6/1990 Foster ..... B05B 11/028 222/209
4,962,870 A * 10/1990 Schneider ..... B05B 11/1028 222/207
5,125,539 A * 6/1992 Schneider ..... B05B 11/028 222/207
5,346,324 A * 9/1994 Kuo ..... A46B 11/0079 401/269
5,351,862 A * 10/1994 Weag ..... B05B 11/028 222/327
5,544,789 A 8/1996 Gillingham
5,673,814 A 10/1997 Terashima et al.
5,924,603 A 7/1999 Santagiuliana
6,406,207 B1 * 6/2002 Wiegner ..... B05B 11/1067 401/187
7,028,865 B2 * 4/2006 Heukamp ..... B05B 11/1028 222/257
7,246,723 B2 7/2007 Santagiuliana
7,677,415 B2 * 3/2010 Auer ..... B05B 11/1035 239/455
8,118,195 B2 * 2/2012 Decottignies ..... B05B 11/1028 222/386
8,225,966 B2 * 7/2012 Canfield ..... B29C 45/1657 222/207
8,602,265 B2 * 12/2013 Decottignies ..... B05B 11/007 222/207
9,945,371 B2 * 4/2018 De Regt ..... B05B 11/0044
10,252,841 B2 * 4/2019 Knight ..... B65D 47/32
10,525,493 B2 * 1/2020 Rossignol ..... F04B 23/028
10,549,299 B2 * 2/2020 Knight ..... F04B 43/00
11,014,108 B2 * 5/2021 Knight ..... B05B 11/0029
2009/0065531 A1 * 3/2009 Decottignies ..... B05B 11/1028 222/207
2009/0212075 A1 * 8/2009 Neuhaus ..... B29C 65/42 222/207
2009/0302064 A1 * 12/2009 Lavabre ..... B05B 11/1032 222/207
2010/0193547 A1 * 8/2010 Laidler ..... B05B 11/1033 222/207
2010/0252577 A1 * 10/2010 Neuhaus ..... B05B 11/1032 222/207
2012/0237377 A1 * 9/2012 Richardt ..... A47K 5/1208 417/473
2013/0008924 A1 * 1/2013 Lafosse ..... B65D 83/0033 222/386
2013/0099900 A1 * 4/2013 Pulvermacher ..... G08B 21/245 340/10.42
2016/0332181 A1 * 11/2016 DeMan ..... B05B 11/1077
2017/0246648 A1 * 8/2017 Rossignol ..... A45D 34/00
2017/0334632 A1 * 11/2017 LaFlamme ..... B05B 11/1028
2018/0318861 A1 11/2018 Knight
2022/0258192 A1 * 8/2022 Knight ..... B05B 11/1028

OTHER PUBLICATIONS

Patent Cooperation Treaty (PCT), International Search Report and Written Opinion for Application PCT/ EP2020/070878 filed on Jul. 23, 2020, dated Oct. 21, 2020 International Searching Authority, EP.

* cited by examiner

ALL-POLYMER PUMP DISPENSER WITH INTERNAL PLUG SEAL

CROSS-REFERENCE TO RELATED APPLICATION

This application is a 35 U.S.C. § 371 national stage application of PCT Application No. PCT/EP2020/070871 filed Jul. 23, 2020, which claims priority to U.S. provisional patent application 62/877,352 filed on Jul. 23, 2019.

BACKGROUND

Containers for everyday household fluid products, such as soaps, cleaners, oils, consumable liquids, and the like, can be outfitted with dispensing pumps to improve a consumer's ability to access and use the fluid. Dispensing pumps of this type usually rely upon a reciprocating pump, driven by a compressible biasing member.

These products reach the end-use consumer via a bulk-shipment retail supply chain or by way of e-commerce (i.e., delivery to the consumer's home or business). Both supply chains require safeguards against damage and/or leakage of fluid caused by dropping the container(s), vibration, and the like. However, the e-commerce channel is particularly demanding since it is more cost effective to ship individual containers without any additional packaging. Also, because e-commerce shipping does not involve pallets or other means of confining the container to an upright position, the rotation, inversion, and jostling/vibration of the container and dispensing pump increases the likelihood that fluid can leak from the container. Despite these issues, the need for containers with dispensing pumps that can withstand the rigors of shipment also is expected to grow because of the growing popularity of on-line retailers who sell and ship individual fluid-containing products via e-commerce.

Another concern relates to sustainability. Increasingly, regulatory authorities are requiring consumer products manufacturers to use product packaging and designs that can easily be recycled. As a practical matter for businesses relying on pump dispensers, it is becoming increasingly important to design products made only from polymeric materials that can be recycled without the need to disassemble and/or separate out metal parts and components made from difficult to recycle materials (e.g., thermosetting resins, specialized elastomers, and other materials that either cannot be recovered or that require temperatures and conditions for recycling that are incompatible with the materials used in the other parts within the design).

United States Patent Publication 2018/0318861 discloses a dispenser pump with components that can be integrally formed from the same polymer. A deformable wall in the diaphragm body of this pump eliminates the need to rely upon a metallic biasing member. U.S. Pat. Nos. 7,246,723; 5,924,603; and 5,673,814 also disclose similar "all plastic" type designs for dispensing pumps, except with a "bellows-style" coiled cone instead of a diaphragm body.

An improved pump dispenser made from polymeric materials that are easy to recycle would be welcome. Specifically, a pump design that did not require disassembly and separation of parts into separate recycling streams is needed.

Additionally, a pump design that enables e-commerce shipment without excess packaging or consumer-removed components is required. At present, external sealing plugs are inserted into the dispensing channel of some pumps to avoid leakage during shipment. Not only are these external plugs an added cost, they can be considered as unsightly and difficult to remove by consumers. Further, their positioning on the exterior of the pump gives rise to the possibility that they may become dislodged during shipment. More generally, consumers are not likely to reinstall the plug after the pump is first used, so that current pumps lose a measure of their sealing security when the external plugs are discarded.

Further still, a pump design that included a simple rotational lock to avoid unwanted actuation would be welcomed. Further still, there is a need for a rotational lock that can cooperate with the aforementioned seal plug to allow for seamless, first time activation and use.

SUMMARY OF INVENTION

Operation of the invention may be better understood by reference to the detailed description, drawings, claims, and abstract—all of which form part of this written disclosure. While specific aspects and embodiments are contemplated, it will be understood that persons of skill in this field will be able to adapt and/or substitute certain teachings without departing from the underlying invention. Consequently, this disclosure should not be read as unduly limiting the invention(s).

A reciprocating pump dispenser can be made entirely from recyclable materials, such as polymers, without the need for metal components. The pump includes an internal plug that initially seals the container at an inlet formed in a closure body that seals between the pump and the container. A single resilient bellows encloses and defines a pump chamber immediately above the inlet/plug. When the actuator head is initially rotated, the internal plug is displaced from its initial seal and becomes coupled to the bellows, so as to allow for pumping and selective resealing of the container depending upon the positioning of the actuator head. The actuator head is desirably rotatable between a dispensing position and a locked, axially-immovable position.

Aspects of our invention proposals are set out in the claims. In certain aspects, the pump can include any or any combination of the following features:

- an actuator head having a dispensing channel communicating with a nozzle outlet;
- a closure body having a top face, at least one engagement feature extending axially upward from the top face, and a recess formed in the top face, said recess including a cylindrical sidewall with a plurality of axially-aligned stoppers positioned along or around the cylindrical sidewall and an annular ledge defining an inlet port at a bottom end of the recess, said ledge including a cylindrical abutment extending axially upward within the recess;
- an internal plug positioned within the annular recess, said internal plug having a annular disk with at least one axially-aligned stopping flange positioned along a periphery of said disk and a plurality of axially-aligned engagement flanges positioned toward a center of said disk;
- a resilient bellows having a cylindrical outlet positioned along a deformable top wall and a cylindrical enclosure extending downward from the deformable top wall, said cylindrical outlet including a plurality of axial outlet flanges, extending below the deformable top wall, with a web formed proximate a terminal end of each axial outlet flange, said web supporting a centrally positioned engagement nub;

the actuator head being biased upward by the resilient bellows, with an outlet of the bellows coupled to the dispensing channel;

the resilient bellows being coupled to the closure body so as to form a pumping chamber defined by the deformable top wall, the cylindrical enclosure, and the top facing;

the inlet port being selectively sealed or held sealed by an annular disk, said annular disk being secured by at least one of: the engagement flanges coupling to the engagement nub and the at least one stopping flange abutting the terminal end of at least one of the axial outlet flanges;

the closure body may be coupled to a container;

both the actuator head and the closure body may include rotational stoppers to limit radial rotation of the actuator head relative to the closure body;

a dip tube may be connected to the inlet port;

an engagement feature on the closure body may secure the resilient bellows to the closure body;

an engagement feature on the closure body may limit radial rotation of the actuator head relative to the closure body;

an outlet valve e.g. flap valve may act against the bellows outlet, e.g. rest on an annular ledge formed within the cylindrical outlet;

an inlet valve e.g. flap valve may rest within the cylindrical abutment of the closure body;

the at least one axially-aligned stopping flange may extend at least in part radially beyond the periphery of the annular disk, so as to be received between two of the axially-aligned stoppers in the recess.

In another aspect, a method of manufacturing and sealing a fluid within a 100% recyclable enclosure for e-commerce shipment is contemplated. Here, a bellows-style pump engine is provided, and a specialized sequence of assembly is used to ensure the internal seal plug functions as intended (i.e., preliminary sealing the inlet of the pump chamber prior to initial actuation of the pump and, thereafter, allowing for normal operation of the same without impediment by the seal plug). Here, any or any combination of the following may be employed:

providing a disassembled pump engine having closure body, a pronged plug seal, a segmented diaphragm, an overcap, an inlet flap valve, and an outlet flap valve, wherein the closure body includes a floor and a recessed inlet sized to receive and engage both the inlet flap valve and the seal plug;

disposing the inlet flap valve within the recessed inlet to create a fluidic seal therebetween;

positioning a said pronged plug seal so that engagement arms on the plug seal extend upward from a top of a sealing member while a bottom of the sealing member fits over the inlet flap valve;

snap-fitting a lower edge of a segmented diaphragm into a peripheral groove formed in the closure body to create pump chamber between the segmented diaphragm and the closure body and disposing the outlet flap valve in an outlet cylinder formed through a top aperture in the segmented diaphragm to create fluidic seal therebetween; and positioning the overcap to sealing engage the outlet cylinder and rotating the overcap to a locked position so as to initially hold the plug seal in place until the overcap is rotated out of the locked position, thereafter causing the engagement arms of the plug seal to move axially in concert with the segmented diaphragm.

DESCRIPTION OF THE DRAWINGS

The appended drawings form part of this specification, and any information on/in the drawings is both literally encompassed (i.e., the actual stated values) and relatively encompassed (e.g., ratios for respective dimensions of parts). In the same manner, the relative positioning and relationship of the components as shown in these drawings, as well as their function, shape, dimensions, and appearance, may all further inform certain aspects of the invention as if fully rewritten herein. Unless otherwise stated, all dimensions in the drawings are with reference to inches, and any printed information on/in the drawings form part of this written disclosure.

In the drawings and attachments, all of which are incorporated as part of this disclosure:

FIG. 2A is a three dimensional perspective view of the top facing of the closure body including the inlet, while

FIG. 3A is a three dimensional perspective view of the top facing of the bellows, while

FIG. 4A is a three dimensional perspective view of the top facing of the internal plug, while

DETAILED DESCRIPTION

Figure 1A:
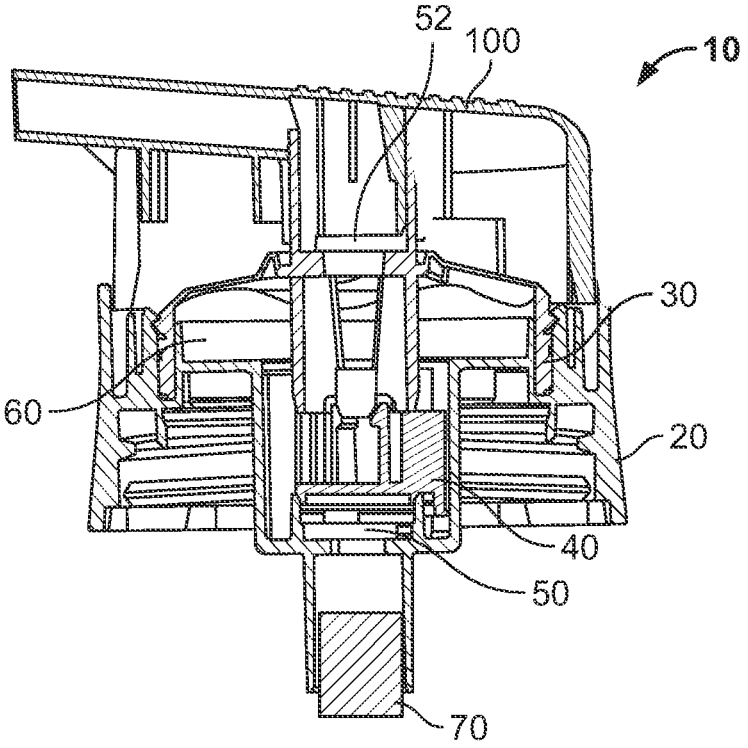
FIG. 1A is a cross sectional side view of the pump dispenser according to certain aspects where the internal sealing plug is positioned to seal the inlet to the bellows and pumping chamber prior to initial actuation (i.e., for e-commerce shipping).
Figure 1B:
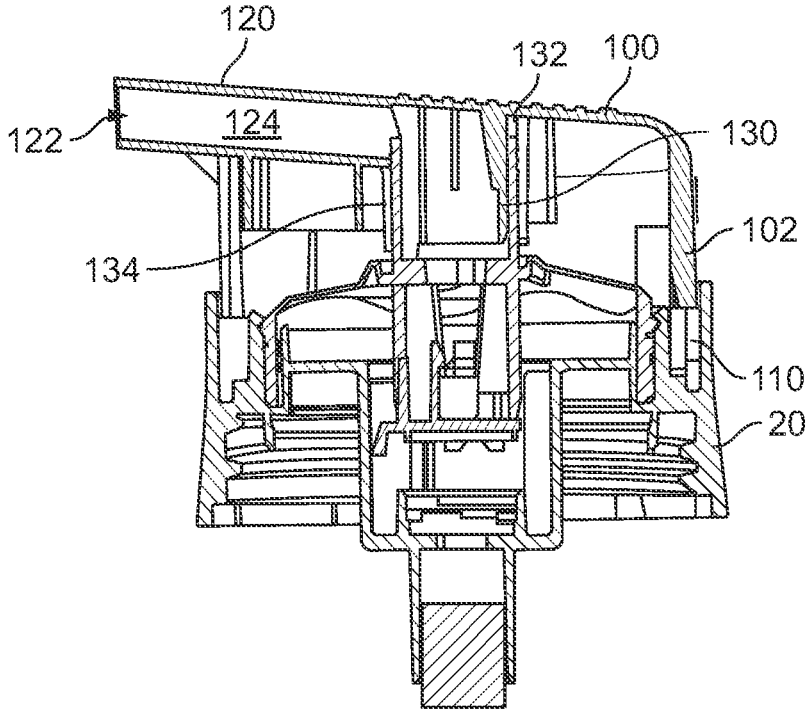
FIG. 1B is a cross sectional side view similar to that of FIG. 1A but wherein the internal sealing plug is coupled to the bellows to enable normal use of the pump.

Specific reference is made to the appended claims, drawings, and description, all of which disclose elements of the invention. While specific embodiments are identified, it will be understood that elements from one described aspect may be combined with those from a separately identified aspect. In the same manner, a person of ordinary skill will have the requisite understanding of common processes, components, and methods, and this description is intended to encompass and disclose such common aspects even if they are not expressly identified herein.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

With reference to the drawings, a dispenser pump is attachable to a container neck. The pump itself includes four main parts, all of which are constructed from the same (or functionally equivalent) polymeric materials so as to simplify recycling. The four parts include an actuator head, a bellows, a closure body, and an internally held plug seal. Further components include a dip tube and a pair of flap valves held at opposite ends of the pumping chamber defined by the plug seal and the bellows.

The dispenser head can be rotated relative to the closure body so as to lock and unlock the reciprocating action of the pump. The bellows are constructed in a segmented fashion so as to create biasing force that urges the actuator head into an extended position. Stops positioned at the interface between the actuator head and the closure body restrict radial and axial motion of those components relative to one another, while the bellows couples to the body at its lower end a dispensing channel and nozzle formed in the head at its upper end.

A pair of flap valves selectively seal the inlet to and outlet from the bellows/pump chamber. The first is positioned at an inlet formed in the closure body, preferably in a sunken cylindrical recess extending axially downward from the floor of the closure body. That inlet communicates with the pump chamber defined by the bellows that attach to the closure body. The outlet valve rests atop a cylindrical outlet formed at the apex of the bellows where it connects to the dispensing channel in the actuator head.

Preferably, along its top facing, the bellows comprises a series of substantially similar flattened segments attached to the sidewalls of the bellow. These segments are arranged equidistantly around and angling upward so as to converge proximate to the upward extending cylinder defining the outlet. This arrangement imparts resilience to the bellows, so as to allow it to function as a biasing member when axial force is temporarily applied to the top facing of the bellows (e.g., through the operation of the actuator head). The sidewalls of the bellows snap fit into a groove on the closure or are otherwise received by the closure body so as to seal the two pieces together and define a discrete pumping chamber with a variable internal volume (owing to the resilient deformability of the bellows) bounded by the inner facings of the bellows and the top facing of the closure body, including the inlet/recess.

An internal plug is also positioned proximate to the inlet of the bellows, preferably seated within the inlet cylinder. The plug includes a circular sealing disk that initially blocks the inlet completely. A plurality of coaxially-arranged extension arms or flanges extend upward and away from the disk, while the disc is formed to conform to the inlet flap in a substantially vertical position. These arms or flanges include formations to snap-fit the arms/flanges to a corresponding downcomer (downwardly-projecting engagement formation) formed on the bellows, as described below. The plug also includes blocking flanges proximate to the periphery of the disc. The blocking flanges ensure the plug stays in a sealing position, so as to block the inlet, prior to the actuation and use of the pump—in this manner, the pump can be shipped and handled without fear of leakage.

The bellows also include a plurality of axially-extending members or flanges arranged in e.g. a circular pattern extending downward from at or adjacent the cylinder defining the outlet. These flanges support and connect to a web structure supporting an engagement nub so that the engagement flange on the plug connects thereto. Thus, the engagement arms/flange(s) of the plug couple to this corresponding feature on the bellows, so as to selectively cause the plug to move in concert with the bellows (particularly after the first actuation upstroke). In this manner, the inlet can be sealed upon the initial assembly of the pump, with a subsequent actuation/release serving to allow the inlet flap valve alone to subsequently control flow into the pump chamber, the plug being lifted clear.

The bellows otherwise has a generally cupped shape, with a rigid cylindrical sidewall that couples to the closure body at the bottom end, a resilient, deformable top wall or cone sealing the sidewall to the outlet cylinder. The resilient nature of the top wall/cone provide biasing force to urge the actuator head axially upward into an extended position.

In operation, when first assembled, the axial flanges on the plug and those on the bellows abut so as to prevent downward motion of the bellows, thereby preventing unwanted pump actuation as well as providing a seal between the plug and inlet leading to the container (also note that the circumferential stoppers on cooperating inner circumferential regions of the closure body and actuator head also assist in this regard). When the head is rotated relative the closure body, the flanges align into corresponding axial slots (while the stoppers on the head and body also rotate out of engagement) so that the head may be depressed.

As noted above, the initial priming action couples the plug to the bellows and displaces the seal when the bellow returns to its upward position. With each downward stroke, the volume of the pump chamber formed between the bellows and the closure body is temporarily reduced, thereby creating suction to draw fluid up into the pump chamber. Once primed, fluid that was previously drawn into the chamber will be dispensed through the outlet flap valve into the dispensing channel and out of the nozzle when the head is depressed. Make up air is admitted back into the container as the bellows expands through separate venting apertures in the head, bellows, and/or closure body, although these apertures only align when these components are rotated into the dispensing position (i.e., so that the axial stops do not restrain movement of the head).

The remaining features of the pump relate to its basic function. For example, a dip tube ensures fluid can be drawn up from the internal volume of the container. The container is configured to couple to the pump body, usually by way of a threaded connection, so that the pump engages a corresponding set of features at or proximate to the container mouth. The container itself must retain the fluid(s) to be dispensed and possess sufficient rigidity and/or venting capability to withstand the pumping motions and attendant pressure differentials created by the structures disclosed herein.

Now, turning more specifically to the aspects depicted in the appended drawings (and more specifically, FIGS. 1A through 4B), pump assembly 10 comprises actuator head 100, closure body 20, resilient bellows 30, and internal plug 40. Inlet valve 50 and outlet flap valve 52 are provided on opposite ends of pump chamber 60, while a dip tube 70 couples to the closure 20 and extends into a container (not shown) so as to facilitate drawing fluid to be pumped into the assembly 10.

Actuator head 100 has a cup-like shape, with a sidewall 102 received within a channel or groove 202 formed on the top facing of the closure body. Inward projections 110 can be formed on an inner circumference of the head 100 to serve as rotational stoppers. A nozzle 120 encompasses the pump assembly outlet 122. A dispensing channel 124 connects outlet 122 to the interface connector 130 where the head 100 connects to the bellows 30. Interface 130 may include an annular flange or groove 132 extending partially or completely around connector piece 130 so as to receive a portion of the outlet tube 361 on the bellows 30 and the downwardly disposed connection cylinder 134 of the connection piece. Notably the dispensing channel 124 may be inclined so that the outlet 122 is elevated in order to avoid unwanted dripping.

Figure 2A:
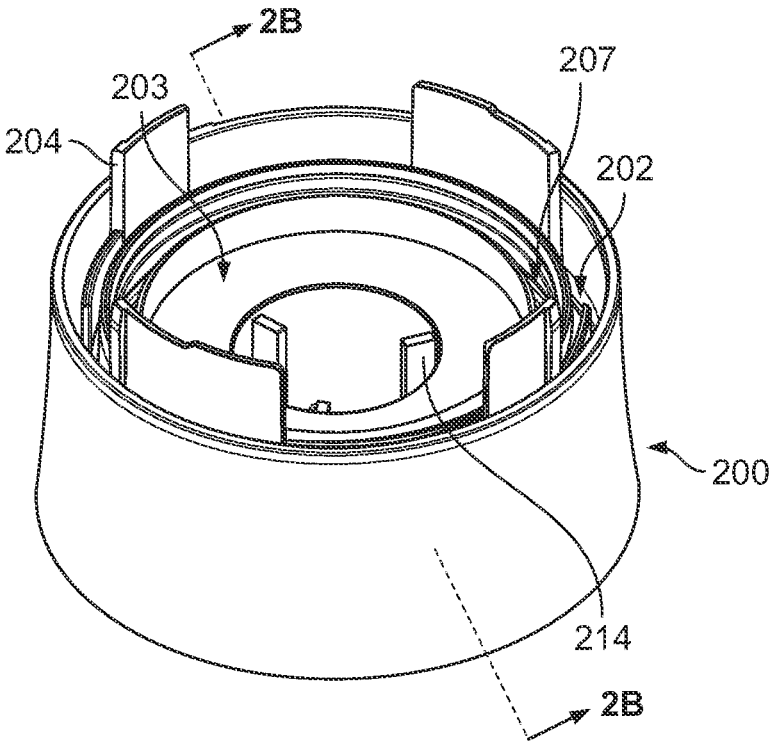
Figure 2B:
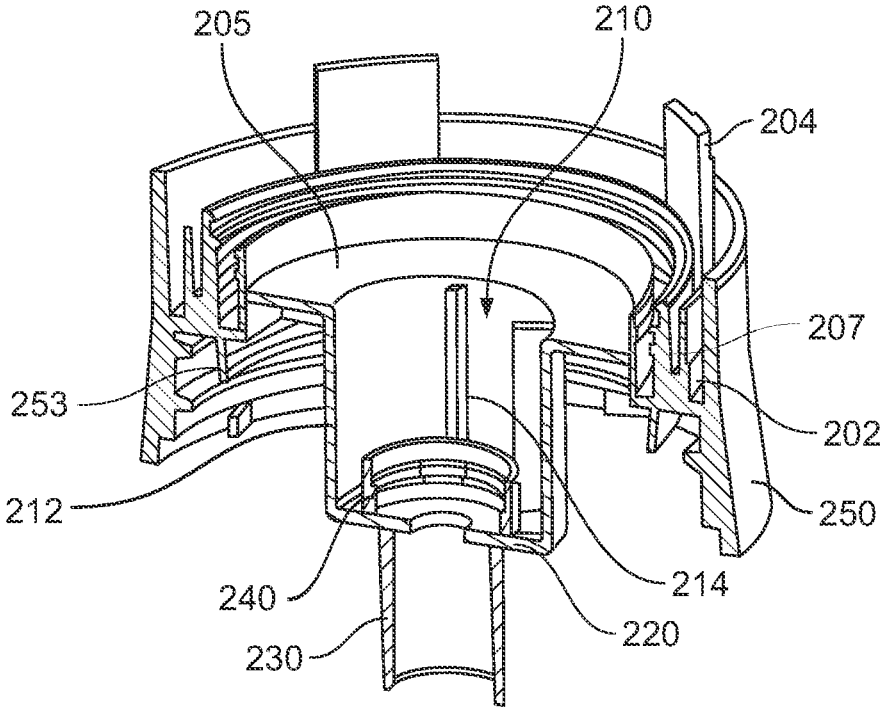
FIG. 2B is a cross sectional view taken along diameter 2B-2B as indicated in FIG. 2A.
Figure 3A:
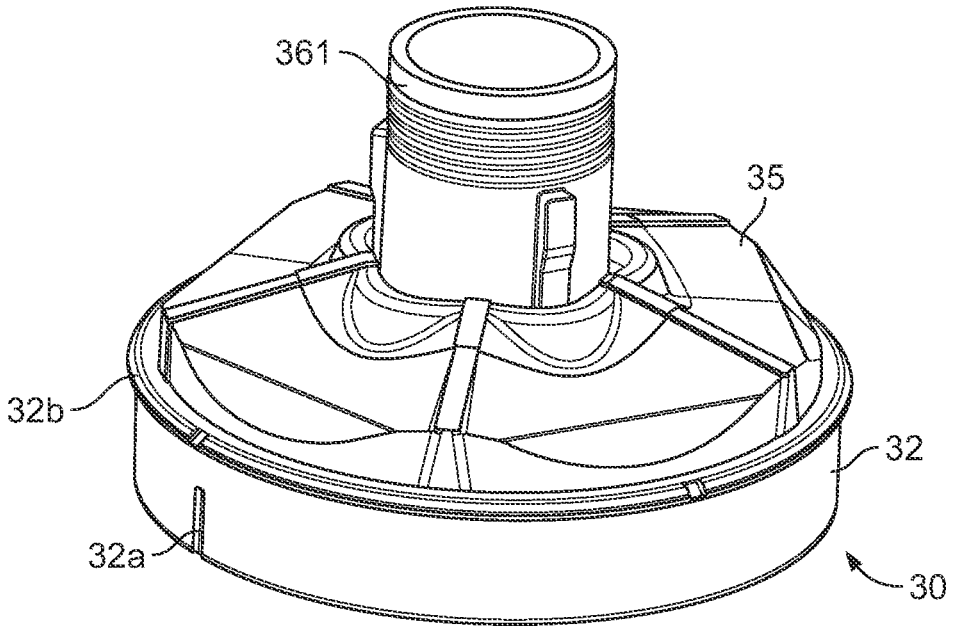
Figure 3B:
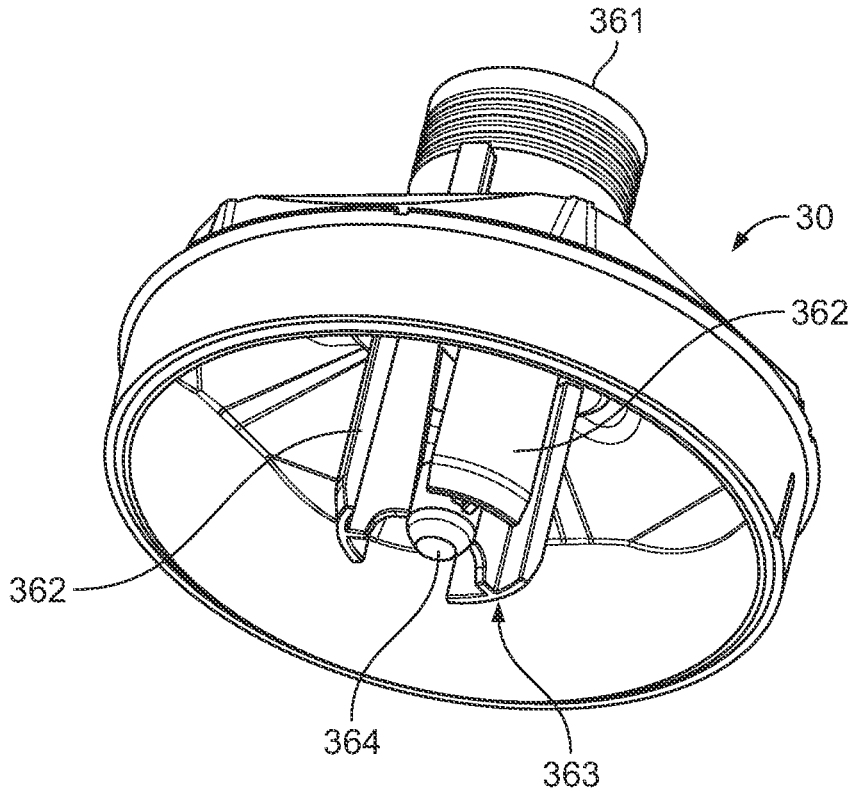
FIG. 3B is a similar view showing its bottom facing.
Figure 3C:
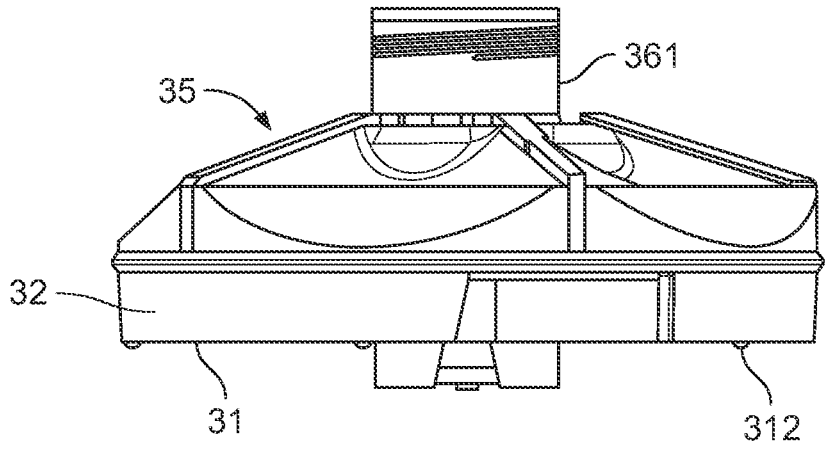
FIG. 3C is a side plan view and FIG. 3D is a top plan view, both ofthe bellows shown in FIG. 3A.
Figure 3D:
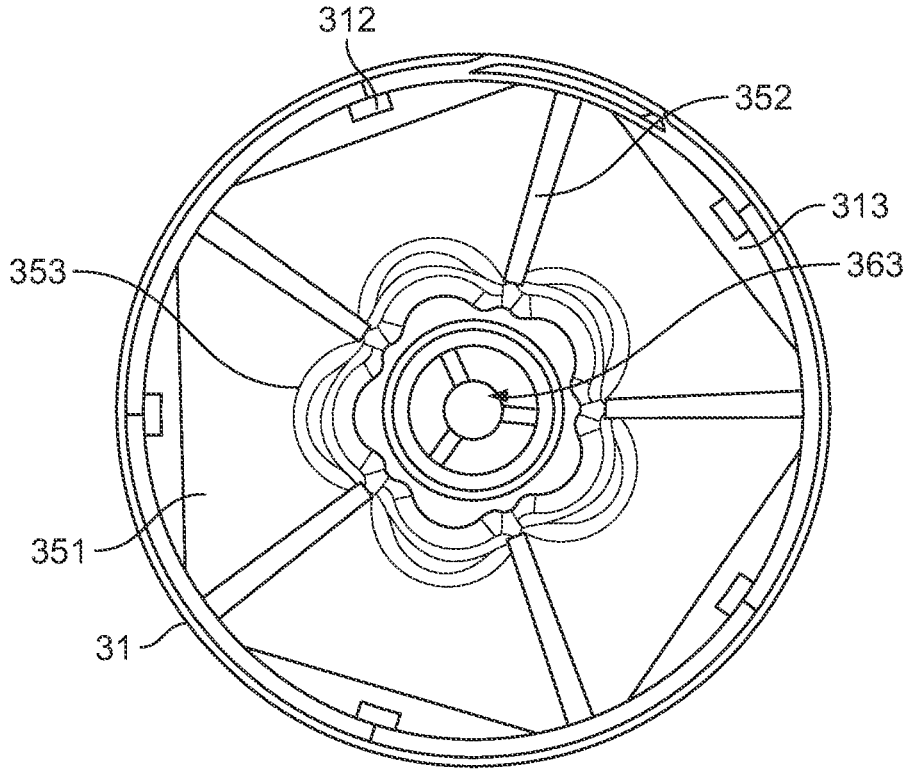
Figure 4A:
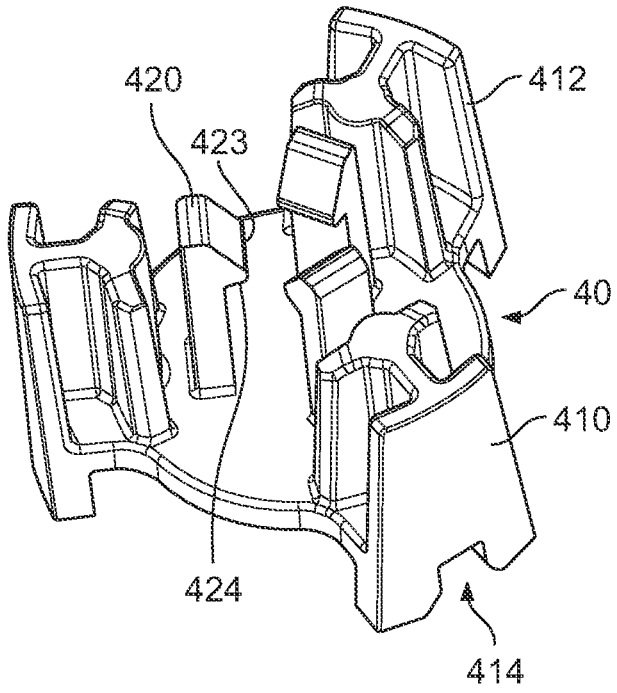
Figure 4B:
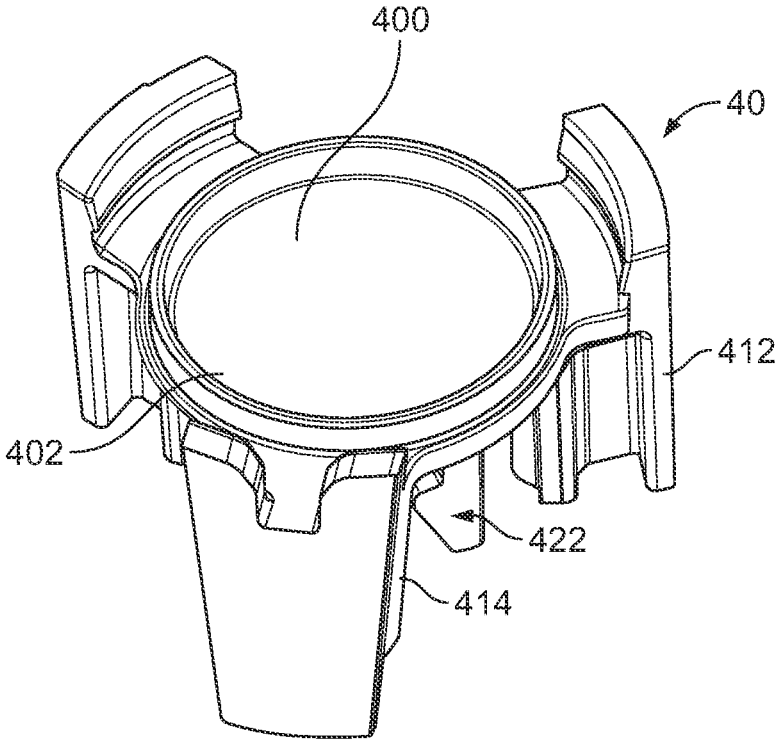
FIG. 4B is a similar view showing its bottom facing.
Figure 5A:
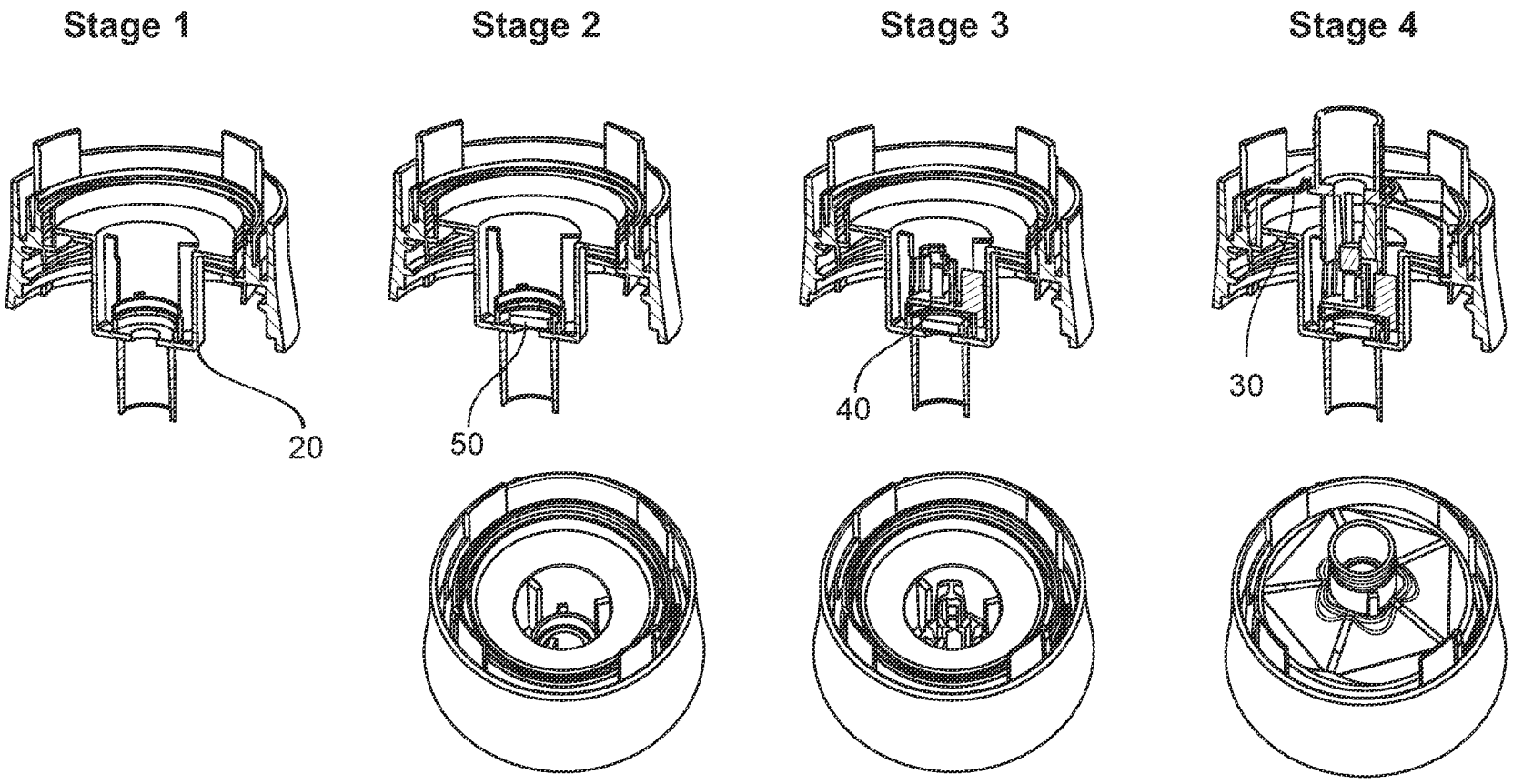
FIGS. 5A and 5B illustrate a sequence in which certain aspects of the pump dispenser can be assembled. Stages 1 through 6 include cross sectional perspective views of the components involved, while Stages 2 through 5 and the Final Assembly also include complete perspective views.
Figure 5B:
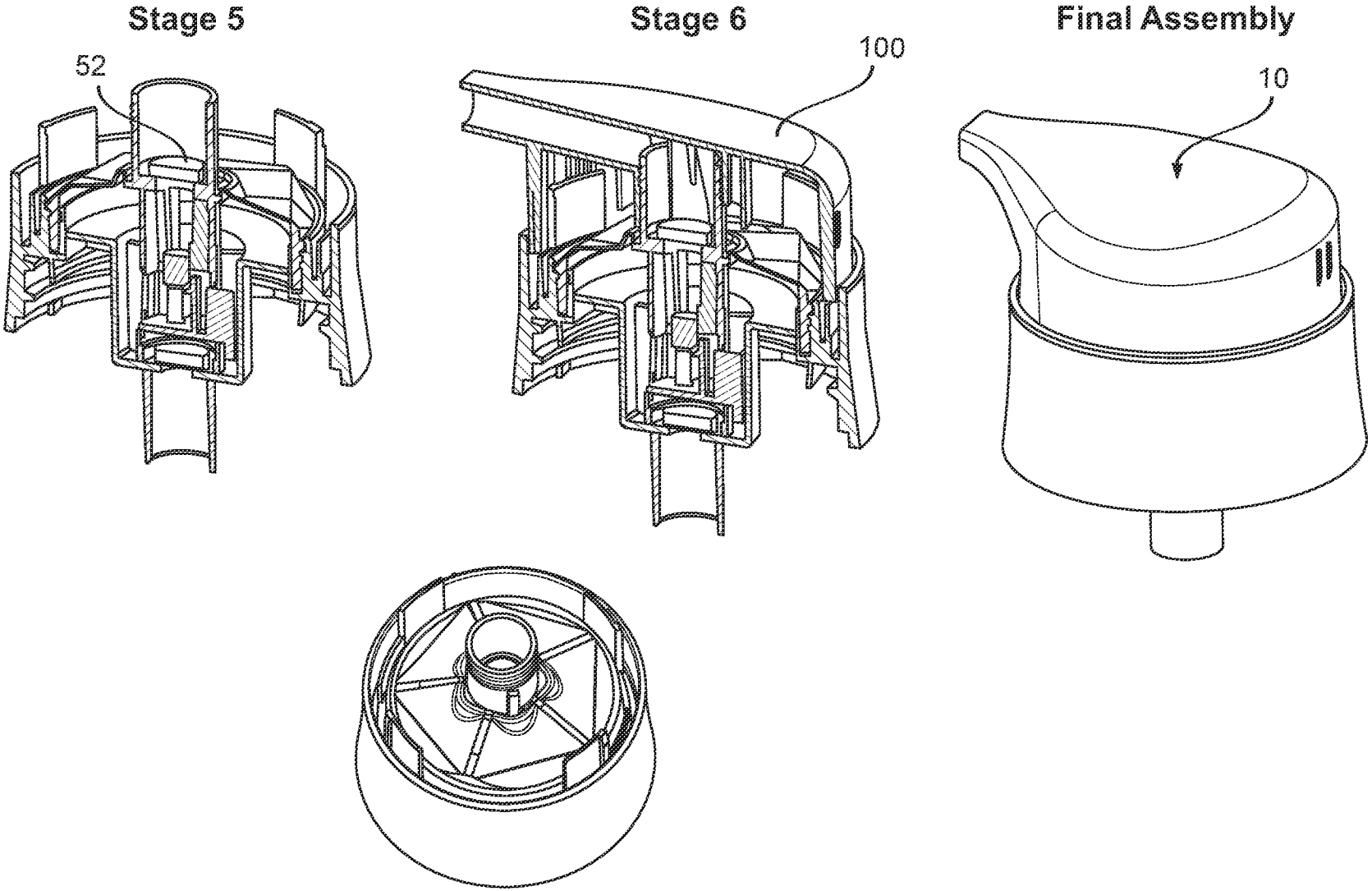

Closure body 20 also has a generally cylindrical shape with an H-shaped cross-section as best seen in FIG. 2A, see also FIG. 5. Outer sidewalls 250 extend in a substantially vertical direction, although a slight taper may be imparted. Horizontal floor 205 connects along a midpoint of the sidewalls 250, although the floor 205 need not be perfectly flat, so as to accommodate features such as groove 202, recess 210, inlet 230, and the like.

Top facing 203 interfaces with the actuator head 100 by coupling to groove 202. A bellows connection groove 207 is formed concentrically within groove 202. Cylindrical extension walls may rise axially upwardly between and/or proximate to grooves 202, 207 to better define the grooves 202, 207 and improve sealing characteristics thereof. If provided, these extension walls may accommodate engagement/coupling features (e.g., beads, grooves, snap-fit projections, flanges, threads, etc.). Flanges 204 extend upward from the facing to serve as rotational stoppers and/or guides during the assembly of the pump 10 and, more specifically, the connection of actuator head 100.

A recess 210 is inset along a central portion of top facing 203. Recess 210 includes a cylindrical or tubular sidewall 212 extending downwardly below the floor/facing 250/203. One or more guide flanges 214 project radially into the recess 210 from the sidewall 212. Flanges 214 may be evenly spaced apart and can fuse into an annular ledge 220 that encases the inlet aperture 230. The ledge 220 has sufficient horizontal clearance to accommodate a cylindrical abutment 240 that extends axially upward. Preferably, the abutment 240 has a lower elevation (in terms of how far upward it extends) in comparison to the flanges 214. Neither the flanges 214 nor the abutment 240 need to project above the plane formed by the floor 205 immediately proximate to recess 210. Also, the abutment 240 should enclose a portion of the ledge 220 so as to accommodate inlet flap valve 50, although valve 50 does not necessarily need to be coupled to the ledge 220 or the closure body 20 (as it will be restrained by the plug 40). The abutment 240 or a similar cylindrical structure may carry through below the ledge 220 to serve as a connection point with dip tube 70.

Cylindrical sidewalls 250 extend below the upward face 203 or floor 205, so as to coaxially enclose the sidewalls 212 of the recess 210, and the bottom edge of sidewalls 250 may coincide with, terminate at a comparatively higher elevation than, or extend beneath the plane defined by ledge 220. Coupling formations (e.g., threads) 252 are provided on the inner facing of sidewalls 250 to facilitate connection of the assembly 10 to a container or other fluidcarrying implement, and a vertical sealing extension 253 may protrude downward from floor 205. As shown, the sidewalls 250 may also extend above the facing 203 to define the groove 202. The flanges 204 may be formed integrally with or radially offset relative to the diameter defined by sidewalls 250.

Bellows component 30 includes a deformable top wall 35 and downwardly extending skirt 32. Skirt 32 effectively forms a cylindrical enclosure for portions of component 30 and may include coupling features 32*a*, 32*b* to facilitate its connection to the closure body 20. An outlet tube 361 extends above the plane formed by top wall 35, while tube-like projections 362 extend downward beyond the skirt 32.

Bellows 30 also includes an outer annular support portion 31, a central rigid hub or actuator connector 361 and a deformable wall 35 extending between them. Preferably, bellows 30 can be a single molding of polypropylene. The annular support structure 31 couples to or is formed integrally with the skirt 32.

In some embodiments, the support 31 may be thicker than the deformable wall 35 to provide firm mounting and support. It is sized to fit within and, preferably, couple to the groove 207. Thus, when the actuator 100 is depressed in a dispensing stroke, hub 361 descends substantially beneath the periphery of the deformable wall 35, pulling in the top of the support ring 31. This disengages or relaxes a seal between the top parts of these components, allowing venting air to enter.

The support ring 31 may also include downwardly-projecting nibs 312 and inwardly-projecting nibs 313. The nibs 312 locate it with slight clearance from top facing 203 to assure venting and also to reduce friction, so that the bellows 30 can be rotated relative to the closure body 20, at least within a predefined arc that coincides with movements permitted by stoppers 204 and/or other structures proximate to or connected with the bellows 30 (e.g., closure body 20, actuator 100, etc.).

The deformable wall 35 has a plurality of gently-inclined segments or facets 351 forming a generally pyramidal shape around the upward connection tube 361. For each facet 351 the hub has a projecting cylindrical portion 353 which is downwardly angled, maintains its rigidity, and meets the facet 351 along a curved boundary so that, when the hub 36 is pushed down, the cylindrical formations 353 force heavy bending of the facet 351 along that boundary, creating a restoring force much greater than would arise from a general bending of the facets sufficient to accommodate the same distance of deformation. Thicker radial ridges 352 extend between the facets 351. While five facets 351 are illustrated, it is possible to apply this design feature to any whole integer between 3 and 9 without departing from the general principle of operation.

Projections 362 extend axially downward from the bellows 30 and, more specifically, the wall 35, spaced around the axis in a tube-like arrangement. These projections 362 can be formed as elongated flanges arranged in a circular fashion to mimic the shape of outlet tube 361, thus giving each projection 362 a T-like shape in which a partial arced wall connects to a radially oriented wall which, in turn, connects to a central nub so as to form a web 363. At a terminal (i.e., lowermost) end of the projections 362, a web 363 is formed. Notably, projections 362 and web 363 do not fully enclose and seal the structure and, instead, openings are deliberately provided so as to allow fluid to flow freely therethrough. However, the projections 362 are sufficiently large to engage and hold the plug 40 in a sealing position over the inlet aperture 230, particularly when the pump is first assembled. Ideally, the number of projections 362 matches the number of stoppers 410 provided on the plug 40.

An engagement nub 364 is held in a generally central position of the web 363. Nub 364 is sized to cooperate with and, in some cases, couple to features on the engagement flanges 420 of the plug 40. When coupled, the nub 364 secures to the plug 40 so that the plug moves in concert with the bellows 30.

Internal plug 40 seals the inlet 230, both in the initial assembly of pump 10 as well as even after the pump 10 has been actuated and used. Plug 40 includes an annular disk 400 which is sized both to fit within the recess 210 and over the abutment cylinder 240. In some embodiments, a downwardly extending annular sealing flange 402 on the underside of disk 400 fits concentrically within abutment 240 to provide a more complete seal. Disk 400 is generally circular in shape, although extension portions 412 may fit between the flanges 214 in the recess 210. In this manner, sufficient clearance is provided to allow the stoppers 420 to disengage from the projections 362 so that the bellows 30 can be initially depressed when the actuator head 100 is rotated.

A series of flanges 410, 420 extend upward from disk 400 toward the bellows 30, preferably in an evenly spaced apart arrangement along the periphery or central core (as relevant to each set of flanges 410, 420). Also, while the flanges 410, 420 are generally shown as having about the same elevation, it may be possible to alter the height of each set provided that the positioning of web 363 and nub 364 are adjusted accordingly. Flanges 410 may have the same T-shape as projections 362 to ensure sufficient interface is achieved. Also, partial flow channels can be provided on either side of disc 400, between the flanges 410, 420 themselves and/or between sealing flange 402 and the lower extensions of flange 410. Further a flow channel 414 may be provided in the bottom edge of one or more of flanges 410 to further facilitate fluid flow around and through the plug 40, particularly after it has been disengaged from its initially assembled, sealing position (i.e., after plug 40 couples to bellows 30, rather than being held in a sealing position over the inlet 230).

Stopping flanges 410 are arranged along the periphery of disk 400. In some embodiments (including the ones shown), these may be positioned partially or completely on extension portions 412 positioned radially outward from disk 400. As shown, the flanges 410 have an T-, I- or H-shape so as to allow the engagement with projections 363 and/or flanges 214, as appropriate to the circumstances. The flanges 410 may extend beneath the plane formed by the disk 400, with at least one aperture 414 provided to facilitate fluid flow under pumping conditions.

Engagement flanges 420 are positioned concentrically within flanges 410. Flanges 420 may align with or be in offset positions from flanges 410. At their uppermost points, engagement flanges 420 include a feature 422 to allow for selective coupling to the nub 364 of the bellows component 30. As illustrated, feature 422 includes a ramp 423 with an underside abutment facing 424, as this ensures smooth and easy coupling to the nub 364. In this arrangement, features 423, 424 effectively create a snap-fit around nub 364.

In another aspect, a method of assembling a dispenser pump is contemplated. The steps of this method are disclosed and illustrated in FIGS. 5A and 5B. In short, a closure body 20 possessing the features described above is first provided (Stage 1). An inlet valve, preferably in the form of a flap valve 50, is seated within the recess of the closure in the second step (Stage 2). In Stage 3, the internal plug 40 is provided above the valve. The resilient bellows 30 is then attached in Stage 4, taking care to position the bellows so that the stoppers/engagement flanges on the plug engage the corresponding flanges/projections on the underside of the bellows, thereby sealing the inlet. In the final two stages 5 and 6, an outlet valve (again, preferably a flap valve 52) is seated proximate to the outlet of the bellows, and then the actuator head 100 is fitted onto the closure. In this manner, a sealed pump assembly 10 is provided, although the pump can easily be activated subsequently by further user intervention, without the need to remove or discard any components.

All components should be made of materials having sufficient flexibility and structural integrity, as well as a chemically inert nature. Certain grades of polypropylene and polyethylene are particularly advantageous, especially in view of the absence of any thermosetting resins and/or different, elastomeric polymer blends. The materials should also be selected for workability, cost, and weight. Common polymers amenable to injection molding, extrusion, or other common forming processes should have particular utility.

The number of flanges, stoppers, and other features shown in the claims are expressly incorporated as if disclosed herein. Thus, without wishing to be limited, one exemplary aspect of the invention involves three flanges 214, three extension portions 412, and three projections 362.

The channels 202, 207, which can serve as first and second attachment grooves, and stopping flanges 204 act as engagement features to couple components and/or cooperate with corresponding features on the actuator 100 head to define limits on the rotational movement of actuator 100 relative to closure 20, as well as the axial movement.

Notably, the dimensions of the components ensure that the initial sealing and seating of the internal plug against the inlet port will be sufficiently strong and secure to enable the pump assembly to shipped in e-commerce channels. Further, when coupled with rotational stops and/or other known up-lock mechanisms, further safeguards against unwanted leakage and actuation can be realized.

The aspects disclosed herein also eliminate the need for any external plug or other sealing devices that must be manually removed by the user. Instead, the internal plug remains within the assembly and, owing to its composition matching that of the other components, the entire assembly can be recycled as a monolithic unit (i.e., without disassembly or separation of those components). In this manner, waste is reduced and the user experience is simplified and improved.

References to coupling in this disclosure are to be understood as encompassing any of the conventional means used in this field. This may take the form of snap- or force fitting of components, although threaded connections, bead-and-groove, and slot-and-flange assemblies could be employed. Adhesive and fasteners could also be used, although such components must be judiciously selected so as to retain the recyclable nature of the assembly.

In the same manner, engagement may involve coupling or an abutting relationship. These terms, as well as any implicit or explicit reference to coupling, will should be considered in the context in which it is used, and any perceived ambiguity can potentially be resolved by referring to the drawings.

Although the present embodiments have been illustrated in the accompanying drawings and described in the foregoing detailed description, it is to be understood that the invention is not to be limited to just the embodiments disclosed, and numerous rearrangements, modifications and substitutions are also contemplated. The exemplary embodiment has been described with reference to the preferred embodiments, but further modifications and alterations encompass the preceding detailed description. These modifications and alterations also fall within the scope of the appended claims or the equivalents thereof.

What is claimed is:

1. A pump dispenser comprising:

an actuator head having a dispensing channel communicating with a nozzle outlet;

a closure body having a top facing, at least one engagement feature extending axially upward from the top facing, and a recess formed in the top facing, said recess having a cylindrical sidewall with a plurality of axially-aligned stoppers positioned along or around the cylindrical sidewall and an annular ledge defining an inlet port at a bottom end of the recess, said ledge including a cylindrical abutment extending axially upward within the recess;

an internal plug positioned within the recess, said internal plug having an annular disk with at least one axially-aligned stopping flange positioned at or around a periphery of said disk and a plurality of axially-aligned engagement flanges positioned toward a center of said disk;

a resilient bellows having a cylindrical outlet positioned along a deformable top wall and a cylindrical enclosure extending downward from the deformable top wall, said cylindrical outlet including or connecting to a plurality of axial outlet flanges, extending below the deformable top wall, with a web formed proximate a terminal end of each axial outlet flange, said web supporting a centrally positioned engagement nub;

wherein the actuator head is biased upward by the resilient bellows, with the cylindrical outlet of the bellows coupled to the dispensing channel of the actuator head;

wherein the resilient bellows couples to the closure body so as to form a pumping chamber defined by the deformable top wall, the cylindrical enclosure, and the top facing; and wherein the inlet port is selectively held sealed by the annular disk, said annular disk being secured by at least one of (i) the engagement flanges coupling to the engagement nub and (ii) the at least one stopping flange abutting the terminal end of at least one of the axial outlet flanges.

2. The pump dispenser of claim 1 wherein the closure body is coupled to a container.

3. The pump dispenser of claim 1 wherein both the actuator head and the closure body include rotational stoppers to limit radial rotation of the actuator head relative to the closure body.

4. The pump dispenser of claim 1 further comprising a dip tube connected to the inlet port.

5. The pump dispenser of claim 1 wherein said engagement feature on the closure body secures the resilient bellows to the closure body.

6. The pump dispenser of claim 1 wherein said engagement feature on the closure body limits radial rotation of the actuator head relative to the closure body.

7. The pump dispenser of claim 1 wherein an outlet flap valve rests on an annular ledge formed at or within the cylindrical outlet.

8. The pump dispenser of claim 1 wherein an inlet flap valve rests within the cylindrical abutment of the closure body.

9. The pump dispenser of claim 1 wherein the at least one axially-aligned stopping flange of the plug extends at least in part radially beyond the periphery of the annular disk so as to be received between two of the axially-aligned stoppers in the recess.

10. A pump dispenser having an initial plug seal to facilitate e-commerce shipping, the pump dispenser comprising:

an actuator head defining a dispensing channel and having axially extending sidewalls;

a closure body having a floor extending between cylindrical sidewalls, said floor including first and second attachment grooves and a central recessed portion including a tubular wall and a ledge defining an inlet and said cylindrical sidewalls of the closure body including stopping flanges to restrict rotational and axial movement of the actuator head relative to the closure body;

a deformable, resilient bellows coupled to the closure body so as to define a pump chamber, said deformable bellows including an upward connection tube forming an outlet from the pump chamber and engagement projections forming a web which extends downward into the pump chamber, said deformable bellows coupled to the actuator head so as to allow axial actuation movement that temporarily alters a volume of the pump chamber;

an inlet valve engaging the ledge and an outlet valve engaging the connection tube so as to selectively seal the pump chamber when the pump dispenser is actuated;

a sealing plug having one or more axial flanges extending upward from a sealing disc, said sealing plug held between the web and the closure body so as to seal the inlet prior to an initial actuation of the pump dispenser and, after the initial actuation of the pump dispenser, coupling to the engagement projections by way of the axial flanges;

wherein the sidewalls of the actuator head are coupled to the closure body by way of the first attachment groove and the bellows is coupled to the closure body by way of the second attachment groove; and wherein the actuator head, the closure body, the bellows, and the sealing plug are made from recyclable thermoplastics.

11. The pump dispenser of claim 10 wherein the actuator head, the closure body, the deformable bellows, and the sealing plug are made from a single thermoplastic material.

12. The pump dispenser of claim 10 wherein the sealing plug includes stopper extensions cooperating with formations on the tubular walls and, prior to the initial actuation, with the web.

13. The pump dispenser of claim 12 wherein the stopper extensions and the disc include and/or define a flow path for fluid to transit the sealing plug after the sealing plug becomes coupled to the bellows.

* * * * *